US006798141B2

(12) United States Patent
Kornfeld et al.

(10) Patent No.: US 6,798,141 B2
(45) Date of Patent: Sep. 28, 2004

(54) PLASMA ACCELARATOR ARRANGEMENT

(75) Inventors: Günter Kornfeld, Elchingen (DE); Werner Schwertfeger, Blaubeuren (DE)

(73) Assignee: Thales Electron Devices GmbH, Ulm (DE)

( * ) Notice: Subject to any disclaimer, the term of this patent is extended or adjusted under 35 U.S.C. 154(b) by 0 days.

(21) Appl. No.: 10/239,274

(22) PCT Filed: Mar. 22, 2001

(86) PCT No.: PCT/DE01/01105

§ 371 (c)(1),
(2), (4) Date: Sep. 20, 2002

(87) PCT Pub. No.: WO01/72093

PCT Pub. Date: Sep. 27, 2001

(65) Prior Publication Data

US 2003/0057846 A1 Mar. 27, 2003

(30) Foreign Application Priority Data

Mar. 22, 2000 (DE) ..... 100 14 034

(51) Int. Cl.[7] ..... H01J 7/24; H01J 17/26

(52) U.S. Cl. ..... 315/111.21; 315/111.61; 315/501; 313/231.31

(58) Field of Search ..... 315/501, 500, 315/111.21, 111.41, 111.61, 111.71–111.91; 313/231.31, 231.41, 161; H01J 7/24, 17/26

(56) References Cited

U.S. PATENT DOCUMENTS

| | | | | |
|---|---|---|---|---|
| 3,626,305 A | | 12/1971 | Furth et al. | 328/233 |
| 3,719,893 A | | 3/1973 | Depackh | 328/233 |
| 4,233,537 A | * | 11/1980 | Limpaecher | 313/231.31 |
| 4,486,665 A | * | 12/1984 | Leung et al. | 250/427 |
| 6,523,338 B1 | * | 2/2003 | Kornfeld et al. | 60/202 |

FOREIGN PATENT DOCUMENTS

| | | | |
|---|---|---|---|
| DE | 43 02 630 | 5/1994 | H05H/1/54 |
| DE | 198 28 704 | 12/1999 | H05H/1/54 |

* cited by examiner

*Primary Examiner*—Don Wong
*Assistant Examiner*—Trinh Vo Dinh
(74) *Attorney, Agent, or Firm*—Collard & Roe, P.C.

(57) ABSTRACT

For a plasma accelerator arrangement having a focused electron beam introduced into a plasma chamber, an annular structure of the chamber and a hollow cylindrical form of the electron beam are presented. A beam-guiding magnet system and, if appropriate, an electrode system is preferably formed in a plurality of stages in an adapted toroidal form.

5 Claims, 2 Drawing Sheets

PLASMA ACCELARATOR ARRANGEMENT

CROSS REFERENCE TO RELATED APPLICATIONS

Applicants claim priority under 35 U.S.C. §119 of German Application No. 100 14 034.3, filed on Mar. 22, 2000. Applicants also claim priority under 35 U.S.C. §365 of PCT/DE01/01105, filed on Mar. 22, 2001. The international application under PCT article 21(2) was not published in English.

BACKGROUND OF THE INVENTION

1. Field of the Invention

The invention relates to a plasma accelerator arrangement having a plasma chamber around a longitudinal axis, having an electrode arrangement for producing an electric acceleration field for positively charged ions over an acceleration section parallel to the longitudinal axis, and having means for introducing a focused electron beam into the plasma chamber and guiding it by means of a magnet system.

2. Prior Art

U.S. Pat. No. 5,359,258 A shows a plasma accelerator arrangement in the form of a Hall thruster, as it is known, having an annular acceleration chamber and a substantially radial magnetic field through the plasma chamber. The anode and anode-stage part of the plasma chamber are magnetically shielding. A gas is introduced into the plasma chamber, which is open on one side in the longitudinal direction, said gas being ionized by electrons and accelerated away from the anode and expelled said electrons coming from a cathode located outside the plasma chamber and being accelerated toward an anode located at the foot of the plasma chamber. The radial magnetic field forces the electrons on closed circular paths around the longitudinal axis of the arrangement and therefore increases their residence time and collision probability in the plasma chamber.

In an ion source which is disclosed by JP 55-102 162 A, in which an annular anode encloses a permanent magnet and, in turn, is surrounded by a circularly cylindrical cathode, a hollow ion beam is expelled from an annular opening.

An arrangement for producing ions with a high kinetic energy, of the order of magnitude of 10 GeV, for physical experiments is disclosed by U.S. Pat. 3,626,305. Here, a ring current of low-energy electrons at 10 MeV, for example, is produced outside an annular vacuum chamber and injected into the compression chamber. From a gas introduced briefly in pulse form, a number of positive ions which is low as compared with the number of ring electrons is produced by means of ionization and is caught in the potential head produced by the electron ring. By means of a strong, briefly pulsed magnetic field, the electrons circulating in the ring are accelerated highly to a ring current of, for example, 50 k-amp. The high magnetic field parallel to the axis of the and associated with the ring current of high-energy electrons comes to interact with a magnetic field produced in the vacuum chamber by inner and outer coils, so that the ring current is highly accelerated in the axial direction. The ions caught in the potential cup of the compressed electron ring system are carried along axially with the ring current and, as a result, are accelerated to a high kinetic energy. In U.S. Pat. No. 3,613,370, a plasma accelerator is described in which an annular plasma chamber is penetrated by a substantially radially oriented magnetic field. Electrons from a central cathode are guided into the plasma chamber through lateral openings in the inner wall of the plasma chamber.

GB 2 295 485 A shows an arrangement for producing an accelerated plasma jet in which, in a cylindrical plasma chamber, electrons emitted by a central cathode are accelerated in the direction of a ring anode. A magnetic field is used to prolong the residence time of the electrons in the plasma chamber in order to improve the ionization efficiently.

U.S. Pat. No. 4,434,130 describes the guidance of two oppositely directed accelerated ion beams from a fusion reactor by means of the space-charge effect of hollow cylindrically guided electrons. The guidance of the electrons moved on spiral paths is carried out with force equilibrium between radially oriented electrostatic fields and centrifugal forces. The ion beams supplied in the axial direction from both sides collide with high energy in the fusion region, whereas the electron beam supplied on one side with conical compression is widened again at the other end and is guided away.

DE 198 28 704 A1 discloses a plasma accelerator arrangement having a plasma chamber around a longitudinal axis, having an electrode arrangement and a magnet system as well as means for introducing an electron beam into the plasma chamber.

In this known arrangement, a circularly cylindrical plasma chamber is provided, in which a strongly focused electron beam generated by a beam generation device is introduced along the longitudinal axis of the cylinder. The electron beam is guided along the cylinder axis by a magnet system which, in particular, can be characterized by alternate polarization of the successive sections. The electrons of the electron beam, introduced into the plasma chamber at high velocity, pass through an electrical potential difference along the longitudinal axis of the plasma chamber, the difference having a decelerating action on the electrons of the electron beam. An ionizable gas, in particular a noble gas, is fed through the plasma chamber and is ionized by the electrons of the electron beam introduced and by secondary electrons. The positive ions produced in the process are accelerated along the longitudinal axis of the plasma chamber by the potential difference and move in the same direction as the introduced electron beam. The ions are likewise guided along the longitudinal axis, focused by the magnet arrangement and by space charge effects and, together with part of the electrons of the electron beam, emerge at the end of the plasma chamber in the form of a neutral plasma beam.

SUMMARY OF THE INVENTION

The present invention is based on the object of specifying a plasma accelerator of this type with a high efficiency.

According to the present invention, the electron beam is not introduced into a circularly cylindrical plasma chamber as a sharply focused beam; instead, for example via an annular cathode surface, a hollow cylindrical beam is produced, which is introduced into a toroidal plasma chamber. The plasma chamber is bounded radially by an outer chamber wall and an inner chamber wall and the hollow beam, with a wall thickness that is lower than the radius of the hollow cylinder, is fed in between these walls and guided by a magnet system. The entire arrangement is preferably at least approximately rotationally symmetrical or at least symmetrical in rotation about a longitudinal axis of the arrangement. The magnet system preferably likewise has a dual toroidal structure with a first magnet arrangement located radially on the outside with respect to the plasma chamber and a second magnet arrangement located on the inside.

As is already the case in the known arrangement, the arrangement according to the invention preferably also contains at least one intermediate electrode in the course of the plasma chamber, in the longitudinal direction, the intermediate electrode being at an intermediate potential of the potential difference along the longitudinal direction of the plasma chamber. The subdivision into a plurality of intermediate potentials permits a considerable improvement in the efficiency, by electrons of low kinetic energy being intercepted at an intermediate electrode with a potential difference that is lower than the current potential of an electron. The efficiency increases monotonically with the number of intermediate potential stages.

In a first embodiment, the magnet system can be designed in one stage with a pole change in each case for the outer and the inner magnet system, by means of opposed magnetic poles spaced apart in the longitudinal direction. At least one of the two magnetic poles in each case is located in the region of the plasma chamber in the longitudinal direction. Both poles of the single-stage magnet system, spaced apart in the longitudinal direction, preferably lie within the longitudinal extent of the plasma chamber. Particularly advantageous is an arrangement in which the magnet system is of multi-stage design having a plurality of successive subsystems in the longitudinal direction, each of which has an outer and an inner magnet arrangement and in which the successive subsystems in the longitudinal direction are alternately aligned in opposite directions.

Particularly beneficial is a plasma accelerator arrangement according to the invention in which, in the longitudinal course of the plasma chamber in the region of the side walls of the plasma chamber, there is still at least one intermediate electrode arrangement which is at an intermediate potential of the potential difference for accelerating the positive ions or retarding the introduced electron beam. On such an intermediate electrode, electrons which have only a low kinetic energy can be intercepted. The potential difference between cathode and anode can as a result be subdivided into two or more acceleration potentials. Losses due to electrons accelerated against the introduced electron beam can be reduced significantly as a result. In particular, the electrical efficiency increases monotonically with the number of potential stages. The electrodes in the longitudinal direction are advantageously in each case placed between the ends of poles of a magnet system or magnet subsystem. This results in a particularly beneficial course of electric and magnetic fields.

BRIEF DESCRIPTION OF THE DRAWINGS

The invention is described in more detail below with reference to the figures and using preferred exemplary embodiments with reference to the figures, in which.

DETAILED DESCRIPTION OF THE INVENTION

In plasma physics, it is known that, as a result of the high mobility of the electrons, caused by their low mass as compared with the normally positively charged ions, the plasma behaves in a similar way to a metallic conductor and assumes a constant potential.

However, if the plasma is located between two electrodes at different potentials, then the plasma assumes approximately the potential of the electrode with the potential that is higher for the positive ions (anode), since the electrons move very rapidly toward the anode until the potential of the plasma is at the approximately constant potential of the anode and the plasma is therefore field-free. Only in a comparatively thin boundary layer at the cathode does the potential fall sharply in the cathode fall, as it is known.

In a plasma, therefore, different potentials can be maintained only when the conductivity of the plasma is non-isotropic. An advantageously high anisotropy of the conductivity may be produced in a beneficial way in the arrangement according to the invention. Since electrons, as a result of the Lorentz force experience a force at right angles to the magnetic field lines and at right angles to the direction of movement during a movement transversely with respect to magnetic field lines, electrons can certainly be displaced easily in the direction of the magnetic field lines, that is to say in the direction of the magnetic field lines there is a high electrical conductivity, and a potential difference in this direction is easily compensated for. However, an acceleration of the electrons by means of an electric field component at right angles to the magnetic field lines counteracts the aforementioned Lorentz force, so that the electrons move spirally around the magnetic field lines. Accordingly, at right angles to the magnetic field lines, electric fields can be produced without immediate compensation by electron flow. For the stability of such electric fields, it is particularly beneficial if the associated electric equipotential surfaces extend approximately parallel to the magnetic field lines, and therefore electric and magnetic fields are substantially crossed.

Figure 1:
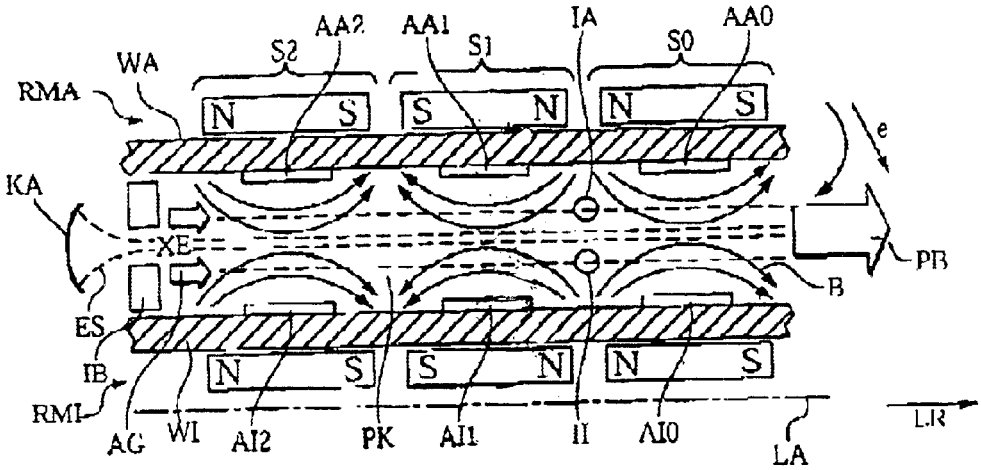
FIG. 1 shows a sectional image of a side view

FIG. 1 shows a multi-stage arrangement according to the present invention, in which a plasma chamber which is substantially toroidal about a longitudinal axis LA as an axis of symmetry and whose form is accessible in individual variations, is fed with a hollow cylindrical electron beam ES, whose cylinder axis coincides with the longitudinal axis LA and whose beam wall thickness DS (FIG. 2) is low as compared with the radius RS of the hollow cylindrical beam form. Such a hollow beam can be produced, for example, by means of an annular cathode and a matched beam system. The electrons of the electron beam have a kinetic energy of typically >1 keV when they enter the plasma chamber. The annular plasma chamber PK is bounded laterally by an inner wall WI and an outer wall WA.

The significant fact in the arrangement according to FIG. 1 is that the magnet system no longer has a single ring around the longitudinal axis LA but that, on the outside with respect to the plasma chamber there is a magnet arrangement RMA which intrinsically has both opposed magnetic poles spaced apart in the longitudinal direction LR. In the same way, located radially on the inside with respect to the plasma chamber, a further magnet arrangement RMI is provided, which again intrinsically has both magnetic poles spaced apart in the longitudinal direction LR.

The two magnet arrangements RMA and RMI are radially opposite each other with substantially the same extent in the longitudinal direction LR. The two magnet arrangements are aligned with the same alignment, that is to say the same pole sequence in the longitudinal direction LR. As a result, identical poles (N—N and S—S) are radially opposite one another, and the magnetic fields are intrinsically closed for each of the two magnet arrangements. The coupe of the magnetic fields from radially opposite magnet arrangements RMA and RMI can, as a result, be viewed as separated by a center surface located substantially at the center of the plasma chamber. The magnetic field lines B run in a curve between the magnetic poles of each arrangement without passing through this center surface, which is not necessarily flat. Therefore, on each radial side of such a center surface, there acts substantially only the magnetic field from one of the two magnet arrangements RMA and RMI.

Figure 3:
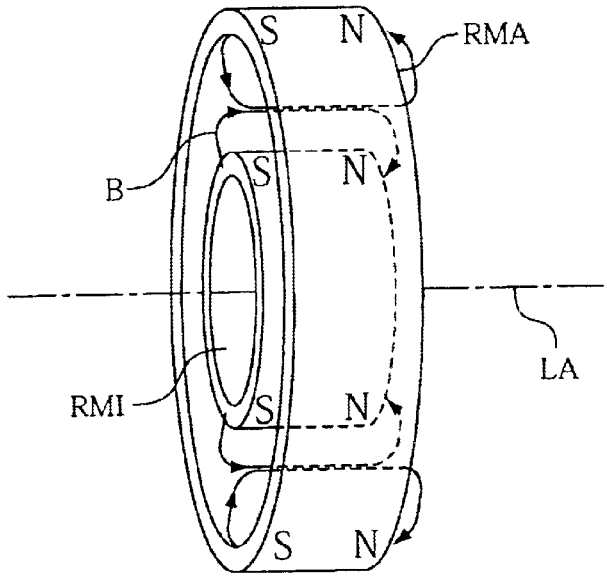
FIG. 3 shows one stage of a magnet arrangement

The above explanations also apply to a magnet system having only a single inner and outer magnet arrangement based. Such a magnet arrangement, can, for example, be formed by two concentric annular permanent magnets having poles spaced apart substantially parallel to the axis of symmetry LA. Such an arrangement is sketched in isolation in FIG. 3.

A particularly advantageous embodiment of the invention provides for the arrangement of two or more such arrangements one behind another in the longitudinal direction LR, the pole alignment of successive magnet arrangements being opposite, as in the known arrangement mentioned at the beginning, so that the poles opposite one another in the longitudinal direction and belonging to successive magnetic arrangements are identical and therefore no magnetic field short circuit occurs, and the field curves described in relation to the single-stage design are substantially maintained for all the successive stages.

The successive magnetic fields firstly act in a focusing manner on the primary electron beam introduced into the plasma chamber and secondly prevent the outflow of secondary electrons produced in the plasma chamber from one stage to the next. An ion barrier IB prevents ions crossing over to the cathode KA.

Preference is given to a plasma accelerator arrangement in which, in the longitudinal course of the plasma chamber, at least one further intermediate electrode is also provided, which is at an intermediate potential of the potential gradient. Such an intermediate electrode is advantageously arranged on at least one side wall, preferably in the form of two part electrodes opposite each other on the inner and outer side wall of the plasma chamber. It is beneficial in particular to position the electrode in terms of its position in the longitudinal direction between two magnetic poles. In the arrangement according to FIG. 1, a plurality of stages S0, S1, S2 each having a magnetic subsystem and each having an electrode system are provided in the longitudinal direction. The magnetic subsystems in each case comprise an inner RMI and an outer RMA magnet ring, as sketched in FIG. 3. The part electrode systems in the successive stages S0, S1, S2 in each case comprise an outer electrode ring AA0, AA1, AA2 and, radially opposite them, an inner electrode ring AI0, AI1, AI2, the extent of the electrodes in the longitudinal direction being substantially the same for the outer and the inner rings. The mutually opposite electrode rings of each subsystem, that is to say AA0 and AI0 and AA1 and AI1 and AA2 and AI2, are in each case at the same potential, it being possible in particular for the electrodes AA0 and AI0 to be at ground potential of the overall arrangement. The inner and outer electrodes AA0, AA1, . . . and the poles of the magnet arrangements can also be integrated into the outer and inner wall, respectively.

The electric fields produced by the electrodes extend, in the regions which are important for the formation of the plasma, approximately at right angles to the magnetic field lines. In particular in the region of the highest electrical potential gradient between the electrodes of successive stages, the magnetic and electric field lines extend substantially crossed, so that the secondary electrons produced along the path of the focused primary electrons, including fully decelerated primary electrons, cannot cause any direct short circuit of the electrodes. Since the secondary electrons can move only along the magnetic field lines of the substantially toroidal multi-stage magnet system, the plasma jet produced is limited substantially to the cylindrical layer volume of the focused primary electrons. There are bulges of the plasma substantially only in the region of the sign change of the axial magnetic field component, where the magnetic field points substantially radially toward the poles of the magnet arrangements. The working gas AG supplied to the plasma chamber, in particular Xenon, is ionized by the primary electrons and in particular the secondary electrons. The accelerated ions, together with decelerated primary electrons from the introduced electron beam, are expelled as a neutral plasma jet PB.

In the arrangement sketched, plasma concentrations result in the longitudinal direction in positions between successive electrodes, which at the same time coincide with the pole points of the successive magnet arrangements. With the arrangement sketched in FIG. 1, the plasma in the individual successive stages can advantageously be connected to the stage-by-stage different potentials of the successive electrodes. For this purpose, in particular the electrodes and the magnet arrangements are arranged in the longitudinal direction in such a way that the physical phase angles of the quasi-periodic magnetic field, as compared with the likewise quasi-periodic electric field measured between the absolute minimum of the magnetic axial field and the center of the electrodes are shifted by at most +/−45°, in particular at most +/−15°. Here, contact between the magnetic field lines and the electrode arranged on the side wall of the plasma chamber can be achieved and, as a result of the easy displaceability of the electrons along the magnetic field lines, the plasma potential can be set to the electrode potential of this stage. The plasma concentrations of different successive stages are therefore at different potentials.

The location of the highest potential gradient in the axial direction is therefore located in a plasma layer which is characterized by the radial magnetic field curves having an electrically isolating effect in the axial direction. At these points, the acceleration of the positive ions in the direction of the electric field accelerating said ions in the longitudinal direction substantially takes place. Since there are sufficient secondary electrons which, as Hall currents, circulate on closed drift paths in the toroidal structure, a substantially neutral plasma is accelerated in the longitudinal direction toward the expulsion opening of the plasma chamber. In the process, in a layer plane at a specific position in the longitudinal direction LR of the arrangement, there are opposed annular Hall currents II and IA at different radii around the longitudinal axis LA, as sketched in FIG. 1 and FIG. 2.

Figure 2:
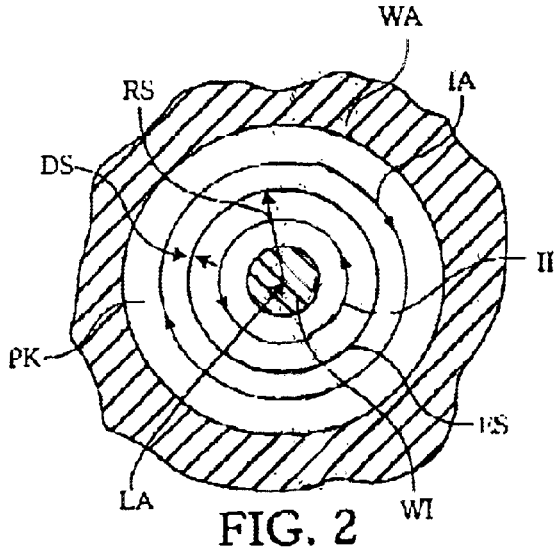
FIG. 2 shows a view in the direction of the longitudinal axis

The aforementioned beneficial phase shift of the quasi-periodic magnetic and electric structures may be achieved firstly by means of an arrangement according to FIG. 2, with the aforementioned permissible displacement by at most +/−45°, in particular at most +/−15°. An alternative variant is sketched in FIG. 4, where the periodic length of the electrode stages $AL_i$, $AI_{i+1}$ spaced apart in the longitudinal direction is twice as great as the periodic grades of successive magnetic ring arrangements. Such an arrangement can also be subdivided into stages with a length twice that of FIG. 1, which then in each case contain two opposed magnet subsystems and one electrode system.

Figure 4:
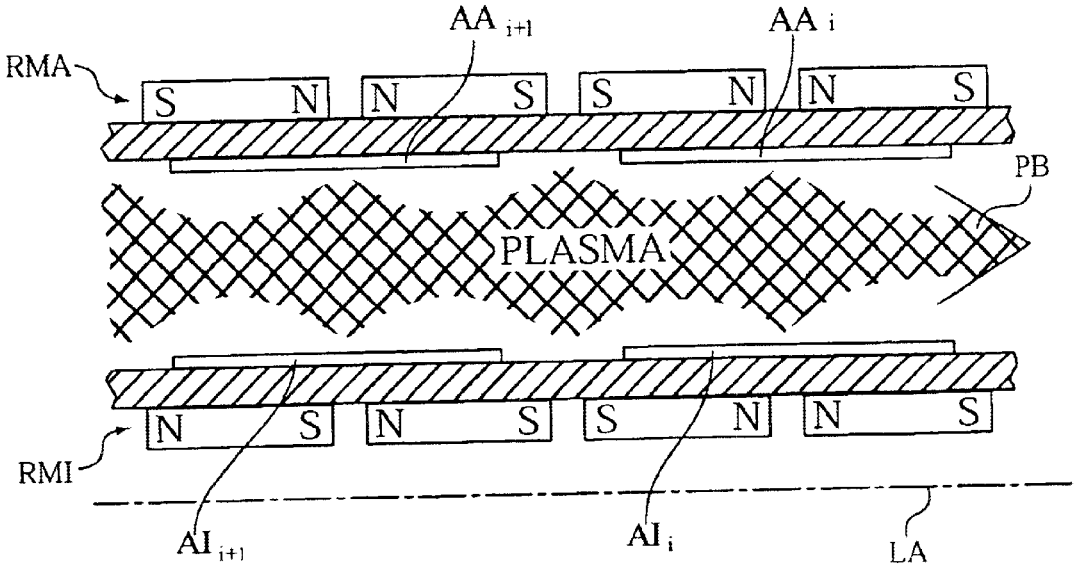
FIG. 4 shows a plasma distribution in a multi-stage arrangement

In the arrangement sketched in FIG. 4, in regions where the electrodes bridge the pole points of successive magnet subsystems, the result is contact zones, in which the secondary electrons following the magnetic lines are picked up by the electrodes, and therefore a contact zone KZ between the plasma and an electrode is produced, whereas at pole points which likewise lie between two successive electrodes in the longitudinal direction, an isolation zone IZ with a high potential gradient is produced in the plasma.

In another embodiment, the opposite outer magnet ring and inner magnet ring of the magnet system or of a magnet subsystem can also be provided with an opposite pole alignment, so that in a longitudinal section through the arrangement, corresponding to FIG. 1, the result for each stage is a magnetic quadrupole field. The currents IA, I1 lying in a plane at right angles to the longitudinal direction are then oriented in the same direction. The other measures outlined according to the invention can be used in a corresponding way in such an arrangement.

The features specified above and in the claims can advantageously be implemented both individually and in various combinations. The invention is not restricted to the exemplary embodiments described, but can be modified in various ways within the scope of specialist knowledge. In particular, strict symmetry about the axis of symmetry SA is not absolutely necessary. Instead, specific asymmetry may be superimposed on the symmetrical course. The annular form of fields, electrodes or magnet arrangements does not necessarily signify a circularly cylindrical form, but can also deviate from one such form both with regard to the rotational symmetry and to the cylindrical course in the longitudinal direction.

What is claimed is:

1. A plasma accelerator arrangement comprising:

a) a plasma chamber that is ring shaped and extends along a longitudinal axis, in which a working gas is supplied that is ionized to produce a plasma;

b) an electrode arrangement comprising a plurality of electrode for producing an electronic potential difference as an electrostatic acceleration field in said plasma chamber for accelerating positively charged ions over an acceleration section extending parallel to said longitudinal axis;

c) an electron beam emitter for introducing a focused electron beam which is in the form of a hollow cylindrical beam; and d) a magnet system for creating a magnetic field comprising a radially inner magnet arrangement comprising a plurality of magnets and a radially outer magnet. Arrangement comprising a plurality of magnets for guiding said focused electron beam inside said plasma chamber wherein said plurality of magnets of both said radially inner magnet arrangement and said radially outer magnet arrangement each have two opposite poles wherein said plurality of magnets are arranged so that extending along the longitudinal axis, like poles are positioned adjacent to each other.

2. The accelerator as in claim 1, wherein said magnet system has a toroidal structure.

3. The accelerator as in claim 1, wherein said electrode arrangement comprises at least one intermediate electrode arrangement having a first part electrode arranged on an outer chamber wall, and a second part electrode located opposite on said inner chamber wall, wherein said first part electrode is positioned at an intermediate potential of said potential difference.

4. The accelerator as in claim 1, wherein said magnetic system comprises a plurality of successive magnetic arrangements spaced apart from one another and extending parallel to said longitudinal axis.

5. The accelerator as in claim 4, wherein said at least one intermediate electrode at least partly covers a pole gap between successive poles of said successive magnetic arrangements.

* * * * *